US009429351B2

(12) United States Patent
Porter

(10) Patent No.: US 9,429,351 B2
(45) Date of Patent: Aug. 30, 2016

(54) DEMAND AIR DOOR HEATER FOR REFRIGERATOR

(71) Applicant: Whirlpool Corporation, Benton Harbor, MI (US)

(72) Inventor: Robert E. Porter, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 745 days.

(21) Appl. No.: 13/684,856

(22) Filed: Nov. 26, 2012

(65) Prior Publication Data

US 2014/0144162 A1 May 29, 2014

(51) Int. Cl.
*F25D 17/04* (2006.01)
*F25D 21/08* (2006.01)

(52) U.S. Cl.
CPC ..... *F25D 17/045* (2013.01); *F25D 21/08* (2013.01); *F25D 2317/0666* (2013.01); *F25D 2700/12* (2013.01)

(58) Field of Classification Search
CPC ..... F25D 17/045; F25D 21/04; F25D 21/08; F25D 2317/0666; H05B 3/84
USPC ..... 62/186, 187
See application file for complete search history.

(56) References Cited

U.S. PATENT DOCUMENTS 4,682,474 A 7/1987 Janke
4,688,393 A * 8/1987 Linstromberg ..... F25D 17/045 62/180
4,732,010 A * 3/1988 Linstromberg ..... F25D 17/045 62/155
4,735,057 A * 4/1988 Janke ..... F25D 17/045 236/49.3
4,843,833 A * 7/1989 Polkinghorne ..... F25D 17/065 62/126
4,903,501 A * 2/1990 Harl ..... F25D 17/045 137/341
5,477,699 A * 12/1995 Guess ..... F25D 17/045 62/187
5,490,395 A * 2/1996 Williams ..... F24F 13/12 137/625.3
6,769,263 B1 * 8/2004 Armour ..... F16K 31/06 62/150
6,910,340 B2 6/2005 Nowak et al.
7,152,419 B1 12/2006 Armour et al.
7,900,465 B2 3/2011 Wetekamp et al.
8,746,005 B2 * 6/2014 Yoon ..... 62/408
2004/0123610 A1 * 7/2004 Nowak ..... F25D 17/045 62/187
2007/0119198 A1 * 5/2007 Scrivener et al. ..... 62/187
2007/0169504 A1 * 7/2007 Vinocur ..... F16K 3/312 62/408
2008/0092574 A1 * 4/2008 Doberstein ..... 62/233
2008/0307807 A1 * 12/2008 Graff ..... F25D 17/045 62/186
2011/0041538 A1 * 2/2011 Yoon ..... 62/275

* cited by examiner

*Primary Examiner* — Allen Flanigan
*Assistant Examiner* — Kun Kai Ma

(57) ABSTRACT

A refrigeration system includes a powered barrier or air door that controls air flow between refrigerated compartments. The powered door includes a powered actuator that is electrically connected to and in parallel with an electric heating element configured to melt ice and/or frost that could otherwise interfere with operation of the door. A switch determines if the door is opened or closed and a controller provides electrical power to the powered actuator and the electric heating element until the door shifts to the desired opened or closed position.

20 Claims, 3 Drawing Sheets

DEMAND AIR DOOR HEATER FOR REFRIGERATOR

BACKGROUND OF THE INVENTION

The present invention relates to refrigeration systems, and in particular to a heater for a door that controls air flow between two compartments of the refrigeration system.

Refrigeration systems may include an insulated freezer compartment and an insulated refrigeration compartment. A refrigeration unit including a compressor, condenser, and evaporator may be utilized to cool the freezer compartment. A powered door ("air door") selectively opens and closes to control air flow from the freezer compartment to the refrigerator compartment. The air door thereby controls the flow of cold air from the freezer compartment into the refrigerator compartment to control the temperature in the refrigerator compartment. A thermostat in the refrigeration compartment may be set to a target temperature, and a temperature sensor in the refrigeration compartment may monitor the actual temperature in the refrigeration compartment. In the event the temperature in the refrigeration compartment is above the target temperature, the door to the freezer compartment is opened, thereby allowing cold air from the freezer compartment to flow into the refrigeration compartment until the temperature drops below the target temperature value.

Ice or frost buildup at the door may, however, interfere with opening and closing of the air door. Heaters have been developed to melt the ice and frost from air doors. However, heaters generally require energy for operation, and known door heater arrangements may provide less than optimum efficiency.

SUMMARY OF THE INVENTION

One aspect of the present invention is a refrigeration system including a freezer compartment and a refrigerator compartment. The system further includes a powered cooling unit that reduces a temperature of air in the freezer compartment. A passageway fluidly interconnects the freezer compartment and the refrigerator compartment. A first sealing surface extends around at least a portion of the passageway. The system further includes a barrier that closes off the passageway when in a closed position to thereby to prevent air flow from the freezer compartment to the refrigerator compartment. The barrier permits air flow from the freezer compartment to the refrigeration compartment when the barrier is in an open position. The barrier defines a barrier surface that faces the passageway when the barrier in its closed position, and a second sealing surface extending around the barrier surface. The first and second sealing surfaces engage one another to prevent air flow past the barrier when the barrier is in the closed position. The system further includes an electrically powered actuator that shifts the barrier between the opened and closed positions. The system also includes an electric heating element extending along one of the first and second sealing surfaces. The system also includes a controller that utilizes at least one operating parameter of the refrigeration system as an input to control the electrically powered actuator and the electric heating element. The powered actuator and the electric heating element are actuated simultaneously. The barrier may comprise a door that pivots or slides.

Another aspect of the present invention is a method of controlling air flow between a freezer compartment and a refrigeration compartment of a refrigeration system. The method includes providing a barrier that moves between opened and closed positions to control air flow between a freezer compartment and a refrigeration compartment. An electrically powered actuator is provided to move the barrier between the opened and closed positions. An electric heating element is provided adjacent the barrier to melt ice to permit the barrier to open and/or close. A sensor indicating if the barrier is opened or closed is also provided. An operating parameter of the refrigeration system is used as a control input to determine when the barrier is to be opened and closed. When the barrier is to be opened, electric power is simultaneously provided to the electrically powered actuator and to the electric heating element until the barrier is open. When the barrier is to be closed, electric power is simultaneously provided to the electrically powered actuator and to the electric heating element until the barrier is closed. The electrically powered actuator and the electric heating element may be connected in parallel whereby electrical power is supplied to the electrically powered actuator and electric heater from a single electrical power source. The operating parameter may comprise an air temperature in the refrigeration compartment.

Another aspect of the present invention is a refrigeration system including a freezer compartment, a refrigeration compartment, and a passageway between the freezer compartment and the refrigeration compartment. The system includes an electrically powered barrier or door that opens and closes to control air flow through the passageway. The door forms a seal closing off the passageway when the door is in the closed position. The system includes an electric heating element adjacent the seal. The electric heating element is connected in parallel to the electrically powered door. The system also includes a controller selectively supplying electrical power to the electrically powered door and to the electrical heating element based on at least one operating parameter of the refrigeration system. The operating parameter may comprise a temperature of the refrigeration compartment. The electrical heating element may comprise an electrical resistance wire forming a loop about an opening of the passageway.

These and other features, advantages, and objects of the present invention will be further understood and appreciated by those skilled in the art by reference to the following specification, claims, and appended drawings.

DETAILED DESCRIPTION

Figure 1:
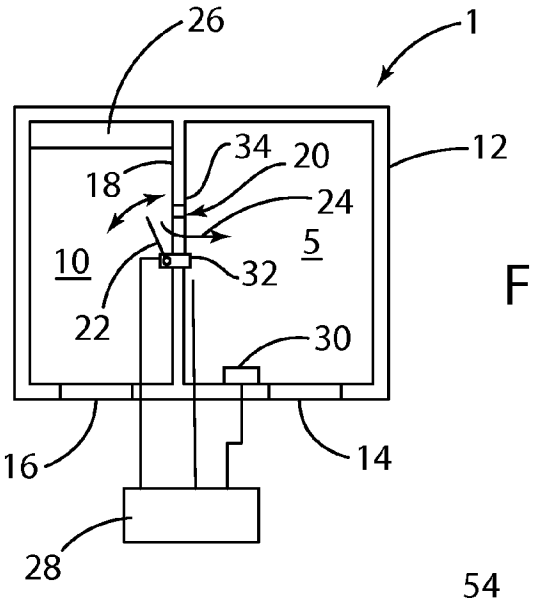
FIG. 1 is a schematic view of a refrigeration system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a refrigeration system 1 according to one aspect of the present invention may include an insulated refrigeration compartment 5 and an insulated freezer compartment 10 that are formed by an insulating structure 12. The insulating structure 12 may include access doors 14 and 16, respectively, which permit user access to food, beverages, or other items stored in the compartments 5 and 10 in a known manner. A divider wall 18 separates the refrigeration compartment 5 and freezer compartment 10. A passageway 20 through divider wall 18 fluidly interconnects the refrigerator compartment 5 with the freezer compartment 10. A powered barrier such as air door 22 selectively opens and closes to permit flow of air 24 between the refrigeration compartment 5 and the freezer compartment 10. A refrigeration unit 26 cools the freezer compartment 10. The refrigeration unit 26 may comprise a conventional refrigeration unit having a compressor, condenser, capillary tube, and evaporator.

A controller 28 is operably connected to a temperature sensor 30. The temperature sensor is configured to provide the controller 28 with the temperature of the air inside the refrigeration compartment 5. A switch 32 and powered door 22 are also operably connected to the controller 28. Switch 32 provides a signal to the controller 28 indicating if the door 22 is in an open position or in a closed position. As discussed in more detail below, an electric heating element 34 is disposed adjacent powered door 22 about passageway 20 to thereby heat and melt ice and/or frost that may otherwise form on or adjacent powered door 22.

Figure 2:
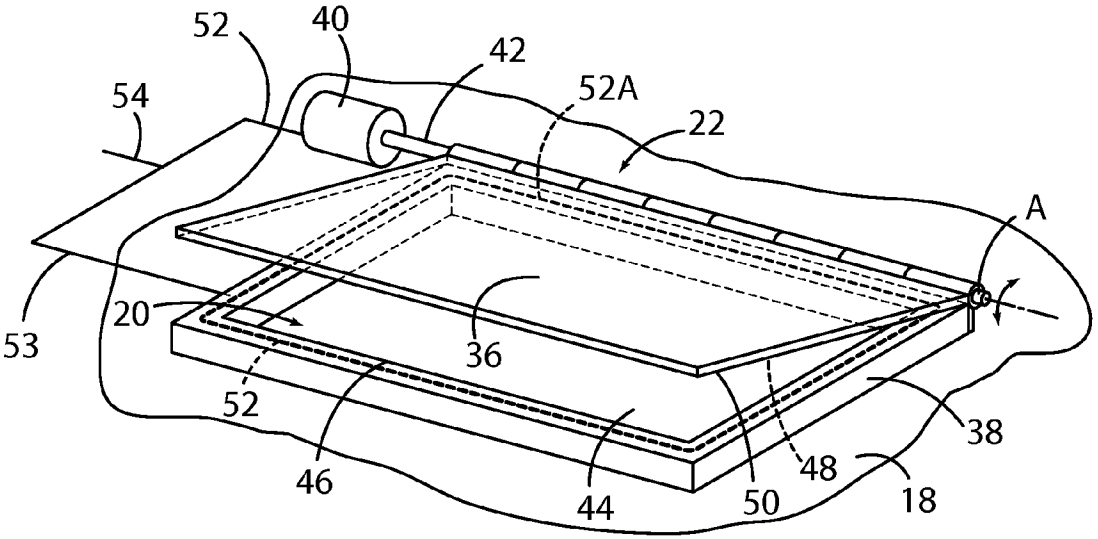
FIG. 2 is a partially schematic isometric view of a heated air door according to one aspect of the present invention.

With reference to FIG. 2 powered door 22 may comprise barrier member such as door member 36 that is pivotably coupled to a support structure 38 for rotation about an axis "A." An electric motor 40 provides for powered rotation of door member 36. The door member 36 may be pivotably mounted to support structure 38 utilizing a shaft or pin 42.

Support structure 38 forms an opening 44 to passageway 20. Opening 44 can be selectively closed off by door member 36 upon actuation of electric motor 40. Support structure 38 includes a first sealing surface 46 that sealingly engages a second sealing surface 48 extending around perimeter 50 of door member 36. The first sealing and second sealing surfaces 46 and 48, respectively, are ring-like in shape and provide a seal such that air cannot pass through opening 44 and passageway 20 when door member 36 is in a closed position. It will be understood that various pivoting doors, electric motors, and corresponding components are known in the art, and the basic operation of these components is therefore known.

An electric heating element 52 extends around the opening 44 adjacent the first and second sealing surfaces 46 and 48 to melt ice and/or frost that could otherwise build up on one or both of the first and second sealing surfaces 46 and 48. In a preferred embodiment, the support structure 38 is a polymer material, and electric heating element 52 comprises a heating wire that is molded into the support structure 38. The electric heating element may comprise a heating wire 52A that is molded into door member 36, and extends around perimeter 50 of door 46. Thus, the electric heating element may comprise a stationary component that extends around opening 44 in divider wall 18, or it may be molded into door member 36 whereby the electric heating element moves with the door 36.

The electrical heating element 52 may be positioned directly adjacent the areas where ice and/or frost tend to form. Ice and/or frost that builds up on or adjacent the first and second sealing surfaces 46 and 48 tends to prevent full closure of the door 36, thereby interfering with the proper operation of the power door 22. Thus, the electric heating element 52 may comprise a ring extending around opening 44 directly adjacent the first sealing surface 46 to provide efficient heating in the areas most prone to ice and/or frost buildup, and to prevent build up of ice and/or frost in the regions where the ice and/or frost is likely to interfere with the powered door 22. As discussed in more detail below, the electric heating element 52 and electric motor 40 may be wired in parallel with input wire 52 electrically connecting electric motor 40 to electric line 54, and with input wire 53 electrically connecting electric heating element 52 to electric line 54. The electric motor 40 and the electric heating element 52 are thereby turned on and off simultaneously based on whether or not electrical power is supplied to a single electric line 54.

Figure 3:
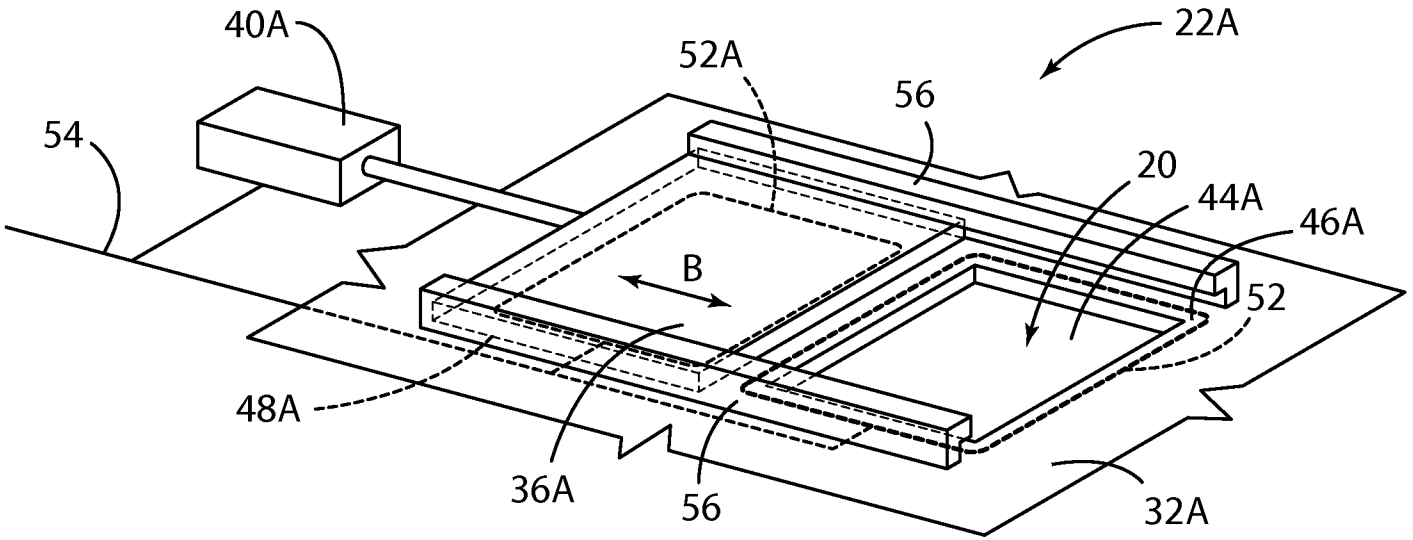
FIG. 3 is a partially schematic isometric view of a heated air door according to another aspect of the present invention.

With further reference to FIG. 3, a powered barrier, such as air door 22A includes a support structure 38A, and a barrier or door member 36A that translates linearly to selectively close off an opening 44A to passageway 20. The door member 36A may be slideably connected to support structure 38A by linear guides 56, and an electrically powered linear actuator 40A provides for powered reciprocating movement of the door member 36A in the direction of the arrow "B" to selectively open and close opening 44A. An electric heating element 52 may be molded into support structure 38A to form a ring around opening 44A to prevent buildup of ice and/or frost in the vicinity of opening 44A. The support structure 38A may form a first sealing surface 46A extending around 44A, and a lower surface of door member 36A may form a second sealing surface 48A that engages first sealing surface 46 when door 36A is in a closed position to thereby seal off opening 44A to passageway 20. The door member 36A and support structure 38A may be made of a molded polymer material or other suitable material. Electrically powered linear actuator 40A selectively shifts the door 36A between the opened and closed position. It will be understood that door member 36A and support structure 38A may be configured as required for a particular application. For example, door member 36A and support structure 38A may be structurally similar to the movable and fixed plates disclosed in U.S. Pat. No. 4,903,501 to Harl, the entire contents of which are hereby incorporated by reference. Various types of linearly translating, electrically actuated barriers/air doors are known in the art, and the details of the door 36A, guides 56, and support structure 38A will not, therefore, be described in detail herein.

Figure 4:
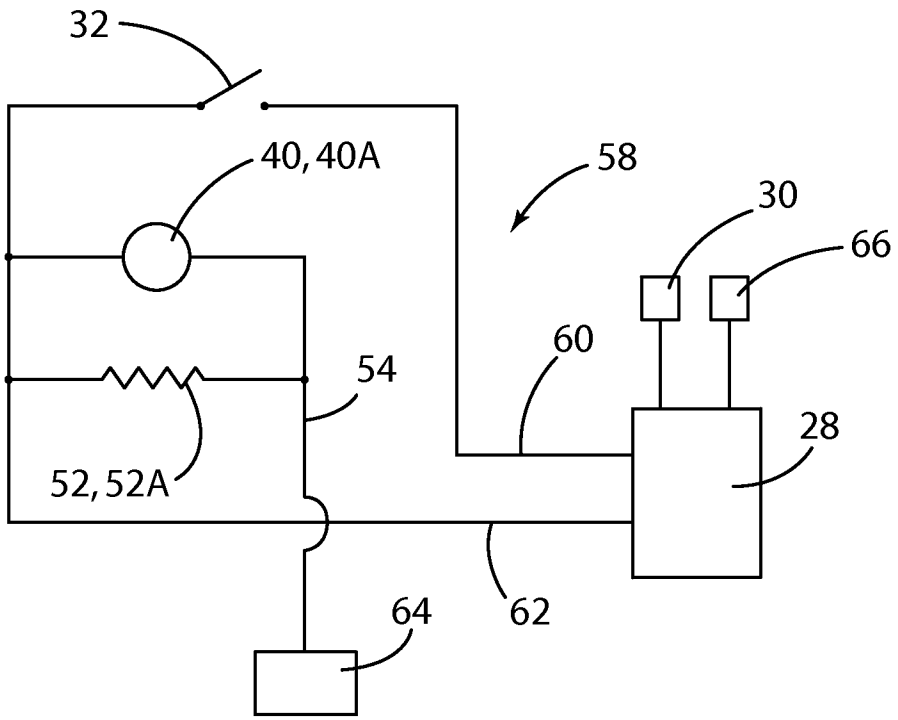
FIG. 4 is an electrical circuit diagram of the refrigeration system.

Electrical heating element 52 and powered actuator 40A are preferably electrically connected in parallel, such that the electrically powered actuator 40A and electrical heating element 52 are both supplied with electrical power from a single line 54. With further reference to FIG. 4, electrical circuit diagram 58 of the refrigeration system 1 includes a controller 28 that is operably connected to a control input line 60 and control output line 62. An electrical line 54 is connected to a power supply 54 to thereby supply power to the electrical actuator 40 or 40A, and to electrical heating element 52 and/or 52A. Switch 32 is operably connected to the door member 36 or 36A to thereby provide a control input to the controller 28 indicating if the door 36 or 36A is opened or closed. The power source 64 may comprise line voltage (e.g. 120 V, 60 Hz) or it may a DC power supply (e.g. 12 V). Temperature sensor 30 is also operably connected to controller 28, and provides controller 28 with a signal corresponding to the temperature of air in the refrigerator compartment 5. A thermostat 66 may be utilized to set a target temperature of the air the refrigeration compartment 5. Thermostat 66 is also operably connected to controller 28.

In use, controller 28 compares the measured temperature in the refrigeration compartment 5 to a target temperature from thermostat 66. If the temperature in the refrigeration compartment 5 is greater than a target temperature, controller 28 generates a signal causing electrical power to be supplied to both the powered actuator 40 and the electrical heating element 52. Electrical power is supplied to the powered actuator 40 and electric heating element 52 until switch 32 provides a signal indicating that the door 36 has opened. In the event ice and/or frost buildup has occurred, thereby preventing door member 36 from immediately opening, electrical power is supplied to electrical heating element 52 until the ice melts, door member 36 opens, thereby actuating the switch 32.

In use, if controller 28 determines that a temperature in refrigerator compartment 5 is lower than a target temperature set by thermostat 66, controller 28 will generate a signal causing electrical power to be supplied to the power actuator 40 and electric heating element 52 until switch 32 generates a signal indicating that the door member 36 has shifted to the closed position. The powered door system 22A of FIG. 3 may operate in a substantially identical manner.

Thus, electrical power is simultaneously supplied to the electric motor 40 (or 40A) and electric heating element 52 (or 52A) until the door member 36 (or 36A) shifts to the desired opened or closed position. This arrangement ensures that the air door reaches the correct position, and also turns off the electric heating element 52 once the door member 36 reaches the correct position. This arrangement reduces energy consumption compared to independently-controlled heating elements.

It will be understood that the rotating air door of FIG. 2 and the sliding air door of FIG. 3 are examples of two types of powered barriers. The present invention may be utilized in connection with a wide range of powered barriers, and the present invention is therefore not limited to a specific door configuration.

The invention claimed is:

1. A refrigeration system, comprising:

a freezer compartment;

a refrigerator compartment;

a powered cooling unit that reduces a temperature of air in the freezer compartment;

a passageway fluidly interconnecting the freezer compartment and the refrigerator compartment;

a first sealing surface extending around at least a portion of the passageway;

a barrier member that closes off the passageway when in a closed position to thereby prevent air flow from the freezer compartment to the refrigerator compartment, and wherein the barrier member permits air flow from the freezer compartment to the refrigerator compartment when in an open position, and wherein the barrier member defines a surface that faces the passageway when the barrier member is in its closed position, and a second sealing surface extending around the barrier member surface, wherein the first and second sealing surfaces engage one another to prevent air flow past the barrier member when the barrier member is in the closed position;

an electrically powered actuator that is mechanically connected to the barrier member and shifts the barrier member from the closed position to the open position;

an electric heating element extending along one of the first and second sealing surfaces;

a controller that utilizes at least one operating parameter of the refrigeration system as an input to control the electrically powered actuator and the electric heating element, wherein when the barrier is to be opened or closed, the controller activates the powered actuator and the electric heating element simultaneously until the barrier is opened or closed.

2. The refrigeration system of claim 1, wherein:

the barrier member comprises a door that pivots between the open and closed positions.

3. The refrigeration system of claim 2, wherein:

the passageway defines an opening, and wherein the first sealing surface comprises a first ring extending around the opening, and the second sealing surface comprises a second ring extending around a peripheral portion of the door.

4. The refrigeration system of claim 3, wherein:

the heating element extends along at least a portion of the first ring.

5. The refrigeration system of claim 4, including:

a divider wall separating the freezer compartment from the refrigerator compartment;

and wherein:

the passageway comprises an aperture in the divider wall.

6. The refrigeration system of claim 1, wherein:

the barrier member comprises a door that slides linearly between the open and closed positions.

7. The refrigeration system of claim 1, including:

a temperature sensor that provides the controller with a signal corresponding to an air temperature in the refrigerator compartment, and wherein the controller actuates the electrically powered actuator based, at least in part, on the air temperature in the refrigerator compartment.

8. The refrigeration system of claim 7, including:

a switch providing the controller with a signal indicating whether or not the barrier member is opened or closed and wherein:

the controller compares the air temperature in the refrigerator compartment to a preset target temperature, wherein the controller provides power to the electrically powered actuator to open the barrier member if the air temperature in the refrigerator compartment is greater than the target temperature, and provides power to the electrically powered actuator to close the barrier member if the temperature in the refrigerator compartment is less than the target temperature, and wherein the controller simultaneously provides power to the electric heating element when power is supplied to the electrically powered actuator, and wherein the controller does not supply power to the electric heating element when power is not being supplied to the electrically powered actuator.

9. The refrigeration system of claim 8, wherein:

the electrically powered actuator is electrically connected in parallel with the electric heating element whereby the electrically powered actuator and the electric heating element are simultaneously controlled by a single output from the controller.

10. The refrigeration system of claim 1, including:

a divider wall between the freezer compartment and the refrigerator compartment; and wherein:

the passageway comprises an opening through the divider wall;

the divider wall comprising polymer material extending around the opening;

the electric heating element is molded into the polymer material and extends around the opening directly adjacent the first sealing surface.

11. The refrigeration system of claim 10, wherein:

the opening is generally quadrilateral, and the barrier member defines a generally quadrilateral perimeter that fits closely around the opening when the barrier member is in a closed position.

12. A method of controlling air flow between a freezer compartment and a refrigerator compartment of a refrigeration system, the refrigeration system having a powered cooling unit that reduces a temperature of air in the freezer compartment and a passageway fluidly interconnecting the freezer compartment and the refrigerator compartment, and a first sealing surface extending around at least a portion of the passageway, the method comprising:

providing a barrier member that moves between open and closed positions to control air flow between a freezer compartment and a refrigeration compartment, wherein the barrier member defines a surface that faces the passageway when the barrier member is in its closed position, and a second sealing surface extending around the barrier member surface, wherein the first and second sealing surfaces engage one another to prevent air flow past the barrier member when the barrier member is in the closed position;

providing an electrically powered actuator that is mechanically connected to the barrier member to move the barrier member from the closed position to the open position;

providing an electric heating element adjacent the barrier member to melt ice to permit the barrier member to open and/or close;

providing a sensor indicating if the barrier member is open or closed;

utilizing an operating parameter of the refrigeration system as a control input to determine when the barrier member is to be opened and closed;

when the barrier member is to be opened, simultaneously providing electric power to the electrically powered actuator and to the electric heating element until the barrier member is opened; and when the barrier member is to be closed, simultaneously providing electric power to the electrically powered actuator and the electric heating element until the barrier member is closed.

13. The method of claim 12, including:

electrically connecting the electrically powered actuator and the electric heating element in parallel whereby electrical power is supplied to the electrically powered actuator and the electric heating element from a single electrical power surface.

14. The method of claim 12, wherein:

the freezer compartment and the refrigeration compartment are fluidly connected by a passageway;

the barrier member forms a seal in the form of a ring around the passageway; and including:

positioning the electric heating element along the seal.

15. The method of claim 12, including:

providing a sensor indicating if the barrier member is open or closed;

pivoting the barrier member between open and closed positions.

16. A refrigeration system, comprising:

a freezer compartment;

a refrigeration compartment;

a passageway between the freezer compartment and the refrigeration compartment;

an electrically powered door including an electrically powered actuator that opens and closes the door to control air flow through the passageway, the door forming a seal closing off the passageway when the door is in the closed position;

an electric heating element adjacent the seal, wherein the electric heating element is connected in parallel to the electrically powered door; and a controller configured to simultaneously supply electrical power to the electrically powered door and the electric heating element based on at least one operating parameter of the refrigeration system, wherein when the barrier is to be opened or closed, the controller activates the powered actuator and the electric heating element simultaneously until the barrier is opened or closed.

17. The refrigeration system of claim 16, wherein:

the one operating parameter comprises a temperature of the refrigeration compartment.

18. The refrigeration system of claim 17, wherein:

the electrically powered actuator and the electric heating element are simultaneously controlled by a single output from the controller.

19. The refrigeration system of claim 16, wherein:

the passageway defines an opening and a sealing surface in the form of a ring adjacent the opening that engages the door to form a seal when the door is in a closed position; and wherein:

the electric heating element extends along the sealing surface.

20. The refrigeration system of claim 19, wherein:

the electric heating element comprises an electrical resistance wire forming a loop about the opening of the passageway.

* * * * *